US010502234B2

(12) United States Patent
Zhu et al.

(10) Patent No.: US 10,502,234 B2
(45) Date of Patent: Dec. 10, 2019

(54) SMART CONTROL WATER PUMP

(71) Applicant: Forcome (Shanghai) Co., Ltd, Shanghai (CN)

(72) Inventors: Xianfei Zhu, Shanghai (CN); Gang Wang, Shanghai (CN)

(73) Assignee: Forcome (Shanghai) Co., Ltd, Shanghai (CN)

( * ) Notice: Subject to any disclaimer, the term of this patent is extended or adjusted under 35 U.S.C. 154(b) by 242 days.

(21) Appl. No.: 15/670,805

(22) Filed: Aug. 7, 2017

(65) Prior Publication Data

US 2018/0266411 A1 Sep. 20, 2018

(30) Foreign Application Priority Data

Mar. 15, 2017 (CN) ..... 2017 2 0250128 U

(51) Int. Cl.
*F04D 29/58* (2006.01)
*F04D 13/08* (2006.01)
(Continued)

(52) U.S. Cl.
CPC ..... *F04D 29/588* (2013.01); *F04D 13/086* (2013.01); *F04D 15/0218* (2013.01); *F04D 29/426* (2013.01); *F04B 17/03* (2013.01); *F04B 49/06* (2013.01); *F04B 2205/11* (2013.01); *F04B 2207/03* (2013.01); *F04D 13/06* (2013.01)

(58) Field of Classification Search
CPC .... F04D 15/0218; F04D 13/06; F04D 13/086; F04D 29/426; F04D 29/586; F04D 29/588; F04D 29/628; F04D 25/082; H02K 5/132
See application file for complete search history.

(56) References Cited

U.S. PATENT DOCUMENTS 3,316,845 A * 5/1967 Schumann ..... F04D 15/0218 417/40
3,464,358 A * 9/1969 Lind ..... H02K 5/132 137/392
(Continued)

*Primary Examiner* — Peter J Bertheaud
(74) *Attorney, Agent, or Firm* — Hamre, Schumann, Mueller & Larson, P.C.

(57) ABSTRACT

The utility model discloses a smart control water pump applicable to ponds and swimming pools for water drainage includes a chassis, an outer housing, an inner housing, a motor front end cap, a motor housing body, a motor rear end cap and an motor insulating cover, wherein the outer housing, the inner housing and the motor housing body are disposed in turn from the outside to the inside; a flow channel is formed between the outer housing and the inner housing; the chassis, together with the motor front end cap and the bottom of the inner housing, forms an impeller cavity; an impeller is disposed in the impeller cavity; the motor rear end cap, together with the motor housing body and the motor front end cap, forms a motor cavity; a motor component which is in transmission with the impeller is disposed in the motor cavity; and the smart control water pump also includes a smart control component, and includes a controlled in the motor insulating cover, and a temperature sensor and a liquid level sensor which communicate with the controller and are disposed at the flow channel. Compared with the prior art, the utility model has the advantages of preventing overturning and toppling and avoiding frozen burning.

10 Claims, 5 Drawing Sheets

(51) Int. Cl.

| | |
|---|---|
| ***F04D 15/02*** | (2006.01) |
| ***F04D 29/42*** | (2006.01) |
| *F04B 49/06* | (2006.01) |
| *F04B 17/03* | (2006.01) |
| *F04D 13/06* | (2006.01) |

(56) References Cited

U.S. PATENT DOCUMENTS

| | | | | | |
|---|---|---|---|---|---|
| 4,275,995 | A * | 6/1981 | Taylor | F04D 15/0218 | 417/360 |
| 4,396,353 | A * | 8/1983 | MacDonald | F04D 15/0218 | 417/36 |
| 4,645,426 | A * | 2/1987 | Hartley | F04D 15/0218 | 417/38 |
| 5,297,939 | A * | 3/1994 | Orth | F04D 15/0218 | 200/84 C |
| 5,425,624 | A * | 6/1995 | Williams | F04B 49/025 | 222/64 |
| 5,775,877 | A * | 7/1998 | Genz | F04D 15/0218 | 200/84 C |
| 5,833,437 | A * | 11/1998 | Kurth | F04D 13/024 | 417/36 |
| 6,390,780 | B1 * | 5/2002 | Batchelder | F04D 15/0236 | 417/17 |
| 7,625,187 | B2 * | 12/2009 | Collins | F04D 15/0218 | 417/36 |
| 10,233,940 | B2 * | 3/2019 | Pohler | F04D 29/426 | |
| 2013/0177450 | A1 * | 7/2013 | Magnusson | F04D 15/0218 | 417/32 |

* cited by examiner (5a)

(5b)

(5c)

SMART CONTROL WATER PUMP

BACKGROUND OF THE INVENTION

1. Technical Field

The utility model relates to the field of smart household appliances, in particular to a smart control water pump.

2. Description of the Related Art

Existing water pumps used for household purposes and used at sites such as ponds and swimming pools are relatively large in size, fail to adapt to a relatively small working space, and when the water is frozen when the water temperature is below 0° C., tend to get stuck, blocked and burned. Moreover, the traditional water pumps with a float switch or a mechanical vertical switch cannot work when toppled or overturned.

BRIEF SUMMARY OF THE INVENTION

The objective of the utility model is to provide a smart control water pump capable of preventing toppling and overturning, avoiding becoming frozen or burning to overcome the defects in the prior art.

The objective of the utility model can be achieved by the following technical solution:

A smart control water pump applicable to ponds and swimming pools for water drainage includes a chassis, an outer housing, an inner housing, a motor front end cap, a motor housing body, a motor rear end cap and an motor insulating cover, wherein the outer housing, the inner housing and the motor housing body are disposed in turn from the outside to the inside; a flow channel is formed between the outer housing and the inner housing; the chassis, together with the motor front end cap and the bottom of the inner housing, forms an impeller cavity; an impeller is disposed in the impeller cavity; the motor rear end cap, together with the motor housing body and the motor front end cap, forms a motor cavity; a motor component which is in transmission with the impeller is disposed in the motor cavity; and the smart control water pump also includes a smart control component, and includes a controlled in the motor insulating cover, and a temperature sensor and a liquid level sensor which communicate with the controller and are disposed at the flow channel.

The motor component includes a motor rotating shaft, a rotor which rotates along with the motor rotating shaft, and a stator fixed on the inner wall of the motor housing body; the upper end of the motor rotating shaft is fixed with the inner side of the motor rear end cap, and the lower end penetrates through the motor front end cap, extends into the impeller cavity and is connected with the impeller.

Two framework oil seals are disposed in turn at the positions of the motor front end cap penetrated by the motor rotating shaft.

The outer housing is a boss-like structure, including an upper housing portion and a housing base in turn from the top down, and a semi-round handle is disposed at the outer edge of the housing base.

The inner housing, together with the motor insulating cover and the motor housing body, forms a cooling oil cavity, and the cooling oil cavity is injected with cooling oil.

The motor front end cap is formed with an oil filler hole at the top, and the oil filler hole is sealed with an oil plug.

A gasket and an O-shaped ring are disposed at the joint of the chassis and the bottom of the inner housing.

A water outlet which communicates with the flow channel is formed on the lateral wall of the upper housing portion, and the water outlet is equipped with an output connection.

The temperature sensor and the liquid level sensor are both fixedly disposed at the flow channel through sensor fixtures; the temperature sensor is positioned in the sensor fixture; the liquid level sensor is provided with three contacts which are heightened in turn; and the contacts are disposed at the inlet of the flow channel at the bottom of the chassis.

The diameter of the housing base is 250 mm.

Compared with the prior art, the utility model has the following advantages:

I. Prevent overturning and toppling: The utility model gets rid of the float switch and the mechanical electromagnetic vertical switch of the traditional water pumps, and ensures that the water pump can always work by preventing the water pump from overturning or toppling; the water pump of the utility model adopts a liquid level control, and when the water pump overturns or topples, the liquid level sensor can still work normally because the liquid level sensor sends signals to a PCB controller and it is ensured that the water pump can work normally by using a controller.

II. Avoid burning in the frozen case: The utility model monitors the water temperature in the water pump in real time through the temperature sensor disposed in the flow channel, and sets the priority of the control signal of the water temperature to be higher than that of the water level signal, so that when the water temperature is below 0° C., the water pump stops working even if changes of the water level are detected, thus preventing the water pump from being stuck in the ice and the water pump from stalling and burning when the environmental temperature is below 0° C.

DETAILED DESCRIPTION OF THE INVENTION

The utility model is described in detail in conjunction with the attached drawings and embodiments.

Embodiment

Figure 1:
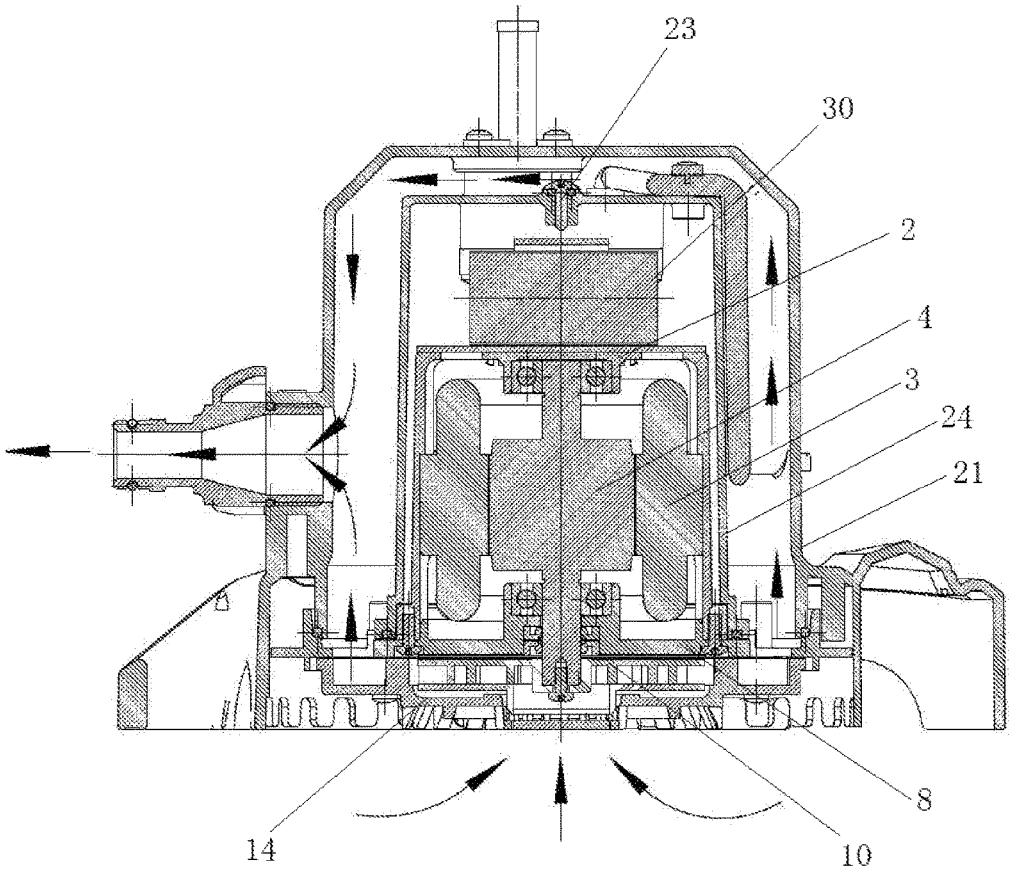
FIG. 1 is a schematic view of the structure and a flow channel of the utility model.
Figure 2:
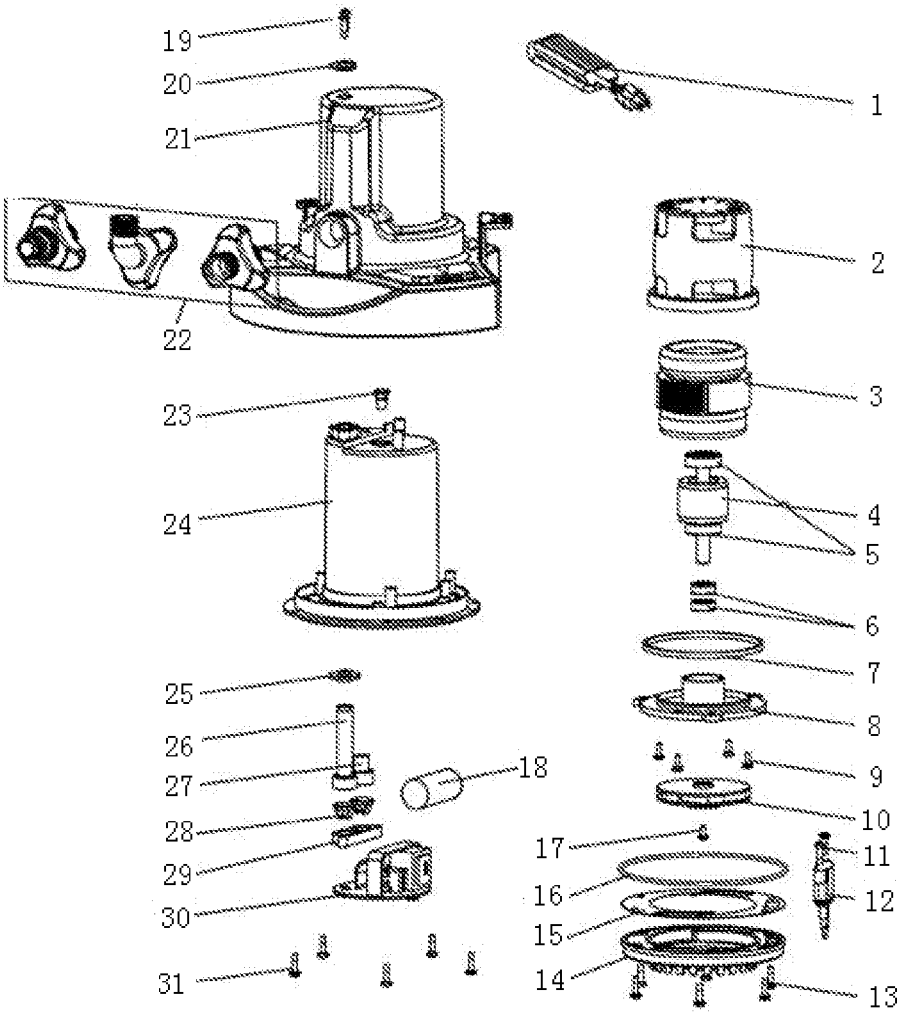
FIG. 2 is a schematic view of assembling and installation of a component of the utility model.

As shown in FIG. 1 and FIG. 2, the utility model discloses a smart control water pump, applicable to ponds and swimming pools for water drainage. The smart control water pump includes a chassis 14, an outer housing 21, an inner housing 24, a motor front end cap 8, a motor housing body, a motor rear end cap 2 and a motor insulating cover 30. The outer housing 21, the inner housing 24 and the motor housing body are disposed in turn from the outside to the inside. A flow channel is formed between the outer housing 21 and the inner housing 24. The chassis 14, together with the motor front end cap 8 and the bottom of the inner housing 24, forms an impeller cavity, and an impeller 10 is disposed in the impeller cavity. The motor rear end cap 2, together with the motor housing body and the motor front end cap 8, forms a motor cavity, and a motor component which is in transmission with the impeller 10 is disposed in the motor cavity. The outer housing 21 is a boss-like structure, including an upper housing portion and a housing base which are disposed in turn from the top down, and a semi-round handle is disposed at the outer edge of the housing base. The inner housing 24, together with the motor insulating cover 30 and the motor housing body, forms a cooling oil cavity, and the cooling oil cavity is injected with cooling oil.

Figure 3:
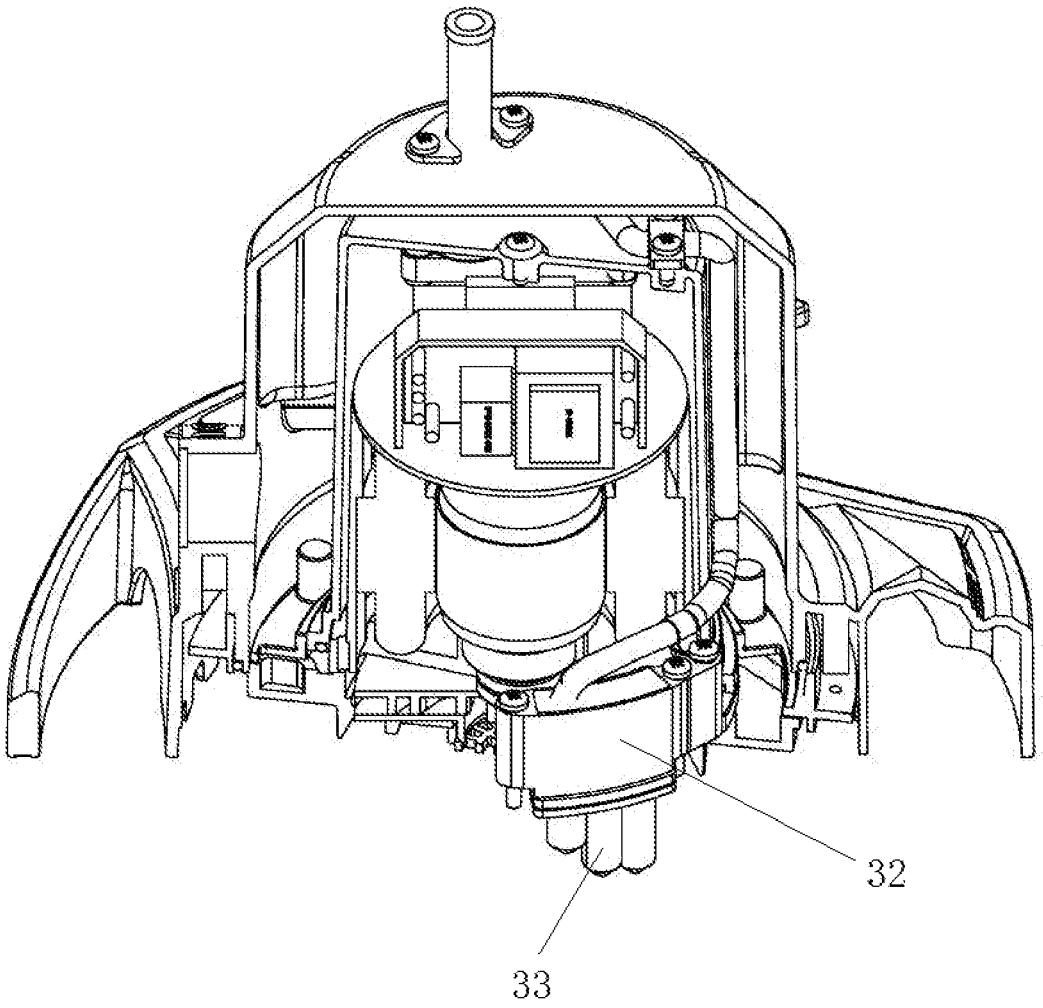
FIG. 3 is a schematic view of a mounted structure of sensors of the utility model.

As shown in FIG. 3, the smart control water pump also includes a smart control component, and includes a controller disposed in the motor insulating cover 30, and a temperature sensor and a liquid-level sensor 33 which communicate with the controller and are disposed at the flow channel; the temperature sensor and the liquid-level sensor 33 are both all fixed at the flow channel through sensor fixtures 32; the temperature sensor is located in the corresponding one of the sensor fixtures 32; the liquid-level sensor 33 is provided with three contacts which detect the water level and are heightened in turn; and the contacts are disposed at the inlet of the flow channel at the bottom of the chassis 14.

The motor component includes a motor rotating shaft, a rotor 4 which rotates along with the motor rotating shaft, and a stator 3 fixed on the inner wall of the motor housing body; the upper end of the motor rotating shaft is fixed with the inner side of the motor rear end cap 2, and the lower end penetrates through the motor front end cap 8, extends into the impeller cavity and is connected with the impeller 10.

Figure 5:
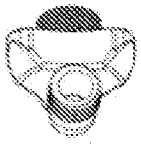
FIG. 5 is a structural view of three output connections, wherein FIG. (5*a*) is a structural view of a knob elbow; FIG. (5*b*) is a structural view of a knob pacifier; and FIG. (5*c*) is a structural view of a knob casing coupling.
Figure 5:
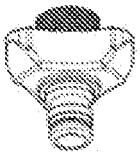
Figure 5:
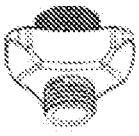

The two framework oil seals 6 are disposed at the positions of the motor front end cap 8 penetrated by the motor rotating shaft in turn; the motor front end cap 8 is formed with an oil filler hole; the oil filler hole is sealed with an oil plug 23; a gasket 15 and an O-shaped ring 16 are disposed at the joint between the chassis 14 and the bottom of the inner housing 24; a water outlet which communicates with the flow channel is also formed on the lateral wall of the upper housing portion; the water outlet is equipped with an output connection 22 which includes a knob elbow, a knob pacifier and a knob casing coupling. As shown in FIG. 5, the diameter of the housing base is standard 250 mm. In the utility model, the diameter of the housing base can be greater than 250 mm, which is not affected by temperature and placement position.

Figure 4:
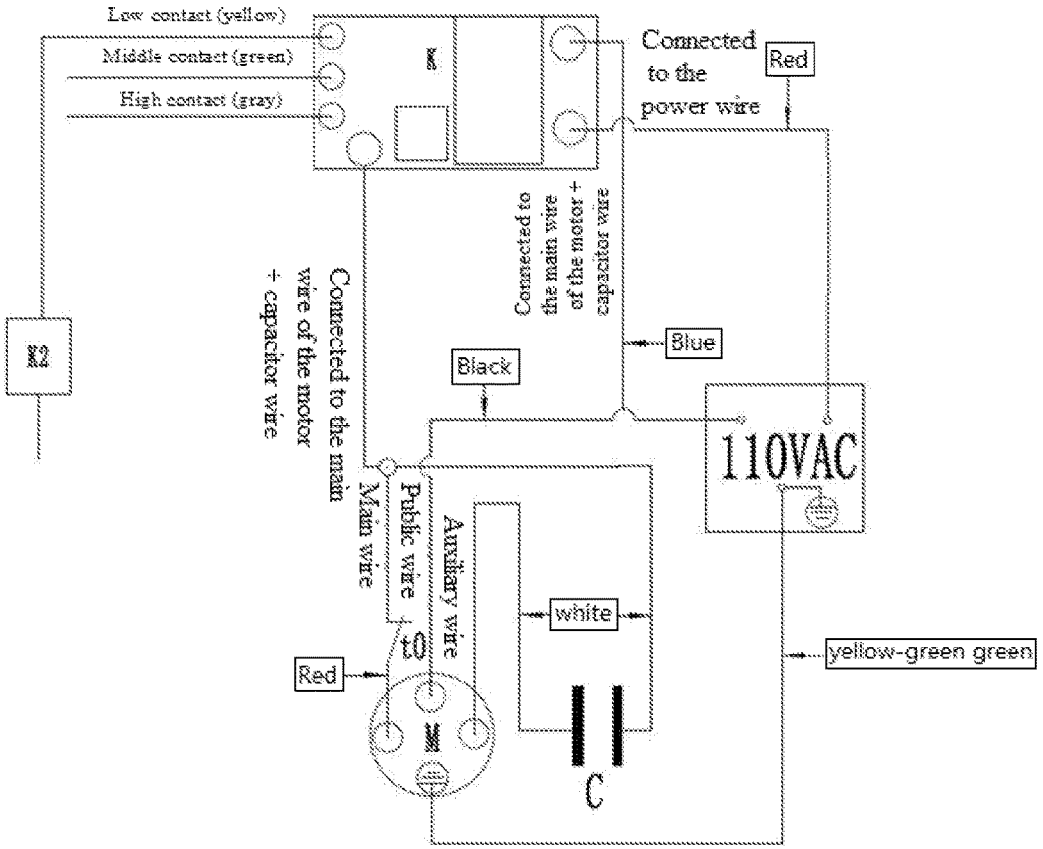
FIG. 4 is a schematic view of electrical working of the utility model.

As shown in FIG. 4, the liquid-level sensor and the temperature sensor are used in the utility mode. The switching function of the whole water pump is controlled by a controller. The liquid-level sensor and the temperature sensor can be automatically switched on or off and re-set in time under proper conditions. As shown in the Figure, K2 is a 0° C. normally-on switch corresponding to the temperature sensor; t0 is a thermal protector; K is a water level switch corresponding to the liquid-level sensor; C is a starting capacitor; and M is a motor.

In the utility model, whether or not the temperature of the use environment is below 0° C. is judged through the temperature sensor K2 first. If the temperature of the use environment is below 0° C., the power of the water pump is cut off, and the water pump does not work; if the temperature of the use environment is above 0° C., the temperature sensor is closed to switch on the power supply. At this time, if the water level reaches one of the contacts of the liquid-level sensor, the water pump works normally; and if the water level is lower than the set position, the water pump stops working, and then whenever the water level reaches the set liquid level position (as long as the temperature is greater than 0° C.), the water pump is started automatically.

All in all, as long as the temperature is greater than 0° C. and the water level reaches the set position of the liquid-level sensor, the water pump can be automatically started and stopped, to avoid the motor from idling and burning, to avoid the water pump from being stuck when the water pump is frozen, and to avoid the water pump from toppling, overturning and stopping working, thus realizing automatic control.

What is claimed is:

1. A smart control water pump, applicable to ponds and swimming pools for water drainage, comprising:

a chassis (14), an outer housing (21), an inner housing (24), a motor front end cap (8), a motor housing body, a motor rear end cap (2), and a motor insulating cover (30), wherein the outer housing (21), the inner housing (24) and the motor housing body are disposed in turn from an outside of the smart control water pump to an inside of the smart control water pump;

a flow channel is formed between the outer housing (21) and the inner housing (24);

the chassis (14), together with the motor front end cap (8) and a bottom of the inner housing (24), forms an impeller cavity;

an impeller (10) is disposed in the impeller cavity;

the motor rear end cap (2), together with the motor housing body and the motor front end cap (8), forms a motor cavity;

a motor component which is in transmission with the impeller (10) is disposed in the motor cavity;

the smart control water pump also comprises a smart control component, and the smart control component comprises a controller disposed in the motor insulating cover (30), a temperature sensor and a liquid level sensor (33) which communicate with the controller and are disposed at the flow channel.

2. The smart control water pump according to claim 1, wherein the motor component comprises a motor rotating shaft, a rotor (4) which rotates along with the motor rotating shaft, and a stator (3) fixed on a wall in the motor housing body;

an upper end of the motor rotating shaft is fixed with an inner side of the motor rear end cap (2), and a lower end of the motor rotating shaft passes through the motor front end cap (8), extends into the impeller cavity and is connected with the impeller (10).

3. The smart control water pump according to claim 2, wherein two framework oil seals (6) are disposed in turn at positions of the motor front end cap (8) penetrated by the motor rotating shaft.

4. The smart control water pump according to claim 1, wherein the outer housing (21) is a boss-like structure, including an upper housing portion and a housing base, and a semi-round handle is disposed at an outer edge of the housing base.

5. The smart control water pump according to claim 1, wherein the inner housing (24), together with the motor insulating cover (30) and the motor housing body, forms a cooling oil cavity, and the cooling oil cavity is injected with cooling oil.

6. The smart control water pump according to claim 5, wherein the motor front end cap (8) is formed with an oil filler hole at a top of the motor front end cap (8), and the oil filler hole is sealed with an oil plug (23).

7. The smart control water pump according to claim 1, wherein a gasket (15) and an O-shaped ring (16) are disposed at a joint between the chassis (14) and the bottom of the inner housing (24).

8. The smart control water pump according to claim 4, wherein a water outlet which communicates with the flow channel is formed on a lateral wall of the upper housing portion, and the water outlet is equipped with an output connection (22).

9. The smart control water pump according to claim 4, wherein the temperature sensor and the liquid level sensor (33) are both fixedly disposed at the flow channel through sensor fixtures (32);

the temperature sensor is positioned in the corresponding one of the sensor fixtures (32);

the liquid level sensor (33) is provided with three contacts which are heightened in turn; and the contacts are disposed at the inlet of the flow channel at a bottom of the chassis (14).

10. The smart control water pump according to claim 4, wherein the diameter of the housing base is 250 mm.

* * * * *